US006161226A

United States Patent [19]

Serewicz et al.

[11] Patent Number: 6,161,226

[45] Date of Patent: Dec. 19, 2000

[54] BASEBALL CHEST PROTECTOR

[75] Inventors: Thomas Anthony Serewicz; Nicholas Sam Gallucci, both of St. Charles, Ill.

[73] Assignee: Everything Baseball Limited, Ltd., St. Charles, Ill.

[21] Appl. No.: 09/396,385

[22] Filed: Sep. 15, 1999

[51] Int. Cl.[7] ..... A41D 13/00

[52] U.S. Cl. ..... 2/459; 2/461; 2/463; 2/45

[58] Field of Search ..... 2/455–456, 459–465, 2/467, 92, 908, 2.5, 44, 45, 268

[56] References Cited

U.S. PATENT DOCUMENTS

| | | | |
|---|---|---|---|
| 3,076,197 | 2/1963 | Glahe | 2/463 |
| 3,125,762 | 3/1964 | Glahe | 2/463 |
| 4,272,847 | 6/1981 | Buhler | 2/463 |
| 4,847,913 | 7/1989 | Chen | 2/2.5 |
| 5,020,156 | 6/1991 | Neuhalfen . | |
| 5,173,964 | 12/1992 | Ball et al. . | |
| 5,204,993 | 4/1993 | Siemens . | |
| 5,319,806 | 6/1994 | Hermann et al. | 2/44 |
| 5,623,729 | 4/1997 | Chen . | |
| 5,742,947 | 4/1998 | Davis . | |

*Primary Examiner*—John J. Calvert
*Assistant Examiner*—Tejash Patel

[57] ABSTRACT

A baseball chest protector with shoulder guards extending over both shoulders of the wearer, to which adjustable straps are attached. The shoulder guards extend just slightly outward of the wearer's shoulder, such that the shoulder is protected but the guard does not interfere with the wearer's throwing motion. The chest protector of the present invention should rest on the wearer's shoulders, ensuring that the protector is properly positioned even when the straps are not perfectly adjusted.

1 Claim, 2 Drawing Sheets

BASEBALL CHEST PROTECTOR

The present invention relates to a chest protector and, in particular, to a chest protector for use by baseball or softball catchers or umpires that includes a shoulder guard for protecting the shoulder of the wearer.

BACKGROUND OF THE INVENTION

Conventional chest protectors for catchers are designed to protect the front of the upper body from being hit by a baseball without restricting the catcher's mobility. In addition, such protectors are designed to be usable by different wearers by adjusting straps arranged on the back of the protector. When such protectors are properly fitted, they protect the lower front portion of the shoulder area, but they do not protect the top portion of the shoulder. Catchers are frequently hit on the top of the shoulder by stray balls, particularly by balls that bounce off of the catcher's face mask. In addition, if the straps are not properly adjusted for the wearer, the chest protector may sag and expose a larger portion of the shoulder and chest area to stray balls.

SUMMARY OF THE INVENTION

The chest protector of the present invention addresses these disadvantages of conventional chest protectors by providing a chest protector with shoulder guards extending over both shoulders of the wearer, to which adjustable straps are attached. The shoulder guards are of lightweight material, such as the material used for other portions of the chest protector, and they may be integrally formed with the chest protector, or they may be separately manufactured and attached to the chest protector. Each shoulder guard should extend just slightly outward of the wearer's shoulder, such that the shoulder is protected but the guard does not interfere with the wearer's throwing motion. The chest protector of the present invention should rest on the wearer's shoulders, ensuring that the protector is properly positioned even when the straps are not perfectly adjusted.

Further objects, features, and advantages of the invention will become evident from a consideration of the following detailed description when taken in conjunction with the accompanying drawings and the appended claims.

BRIEF DESCRIPTION OF THE DRAWINGS

For the purpose of facilitating an understanding of the invention there are illustrated in the accompanying drawings preferred embodiments thereof, from an inspection of which, when considered in connection with the following description, the construction and operation of the invention, and many of its advantages, should be readily understood and appreciated.

DETAILED DESCRIPTION OF THE PREFERRED EMBODIMENT

Figure 1:
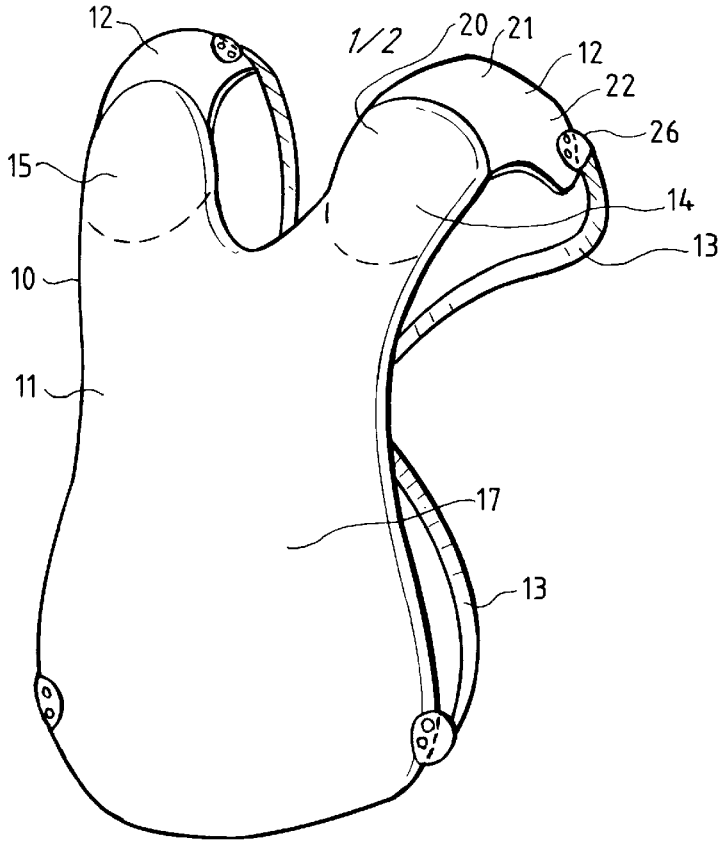
FIG. 1 is a perspective view of a chest protector of the present invention.

As shown in FIG. 1, the chest protector 10 of the present invention comprises a main pad 11, shoulder guards 12, and adjustable straps 13.

The main pad portion 11 may be similar to any conventional chest protector, having a left shoulder portion 14, a right shoulder portion 15, a chest portion 16, and an abdomen portion 17. For a right handed wearer, the left shoulder portion 14 of the main pad 11 may be larger than the right shoulder portion 15; for a left handed wearer, the right shoulder portion 15 may be larger than the left shoulder portion 14. The main pad 11 may be constructed of materials used in conventional chest protectors, and should preferably be lightweight, flexible, and capable of absorbing shock while minimally deflecting the ball. In the embodiment shown the main pad 11 includes an outer casing enclosing a shock absorbent cushion. The outer casing may be made of any suitable material, such as fabric or plastic, and the shock-absorbing cushion may also be made of any suitable material, such as foam or fabric padding.

Figure 2:
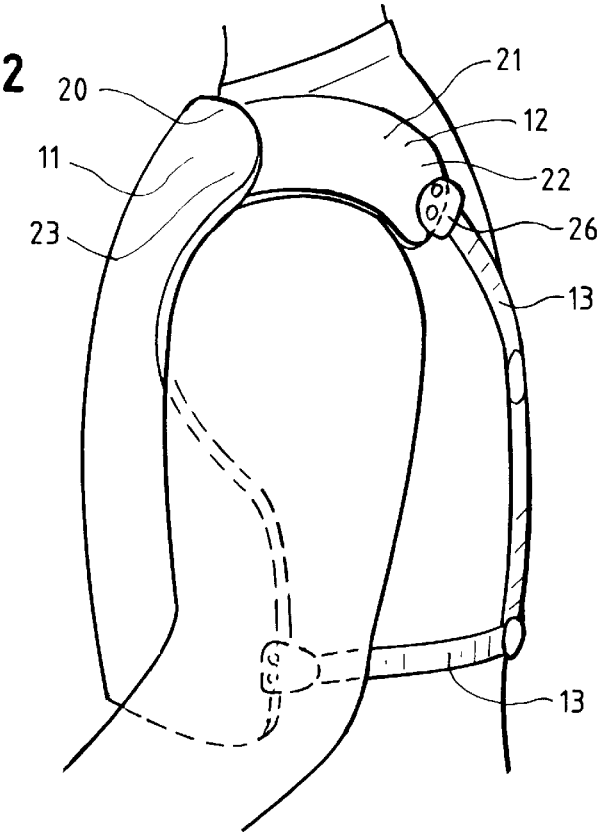
FIG. 2 is a side view of a catcher wearing an embodiment of the chest protector.
Figure 5:
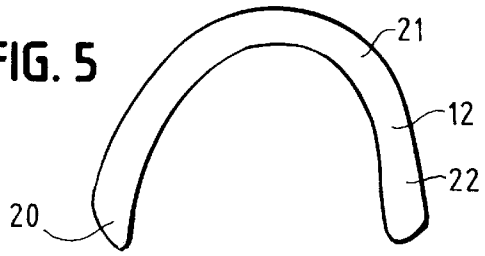
FIG. 5 is a side view of one embodiment of the shoulder guard of the chest protector.
Figure 6:
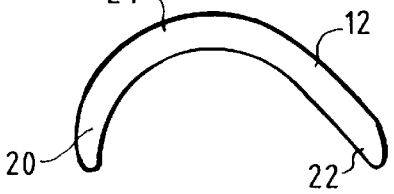
FIG. 6 is a side view of another embodiment of the shoulder guard of the chest protector.

The shoulder guards 12 should be relatively rigid so that they maintain a "U" or "J" shape, as shown in FIGS. 5 and 6, but they should remain flexible enough to be comfortable to wear. The guards 12 are, therefore, preferably made of plastic or any other material that is sufficiently rigid to maintain a "U" or "J" shape but that is flexible enough for comfort. The guards 12 should each have a front portion 20, extending from the top of the shoulder portion of the main pad 14, 15 to the top of the wearer's shoulder, a top portion 21 curving over the wearer's shoulder, and a back portion 22 extending from the top portion 21 down a portion of the wearer's back such that the shoulder is covered and the shoulder guard 12 rests on the wearer's shoulder. The shoulder guards 12 may be integrally formed as part of the main pad 11, or they may be separately formed and attached to the main pad 11 by suitable fastening means 23, such as rivets or snaps. When the chest protector 10 is worn, the "U" or "J" shaped shoulder guards 12 should rest on the shoulders of the wearer, as shown in FIG. 2.

Figure 3:
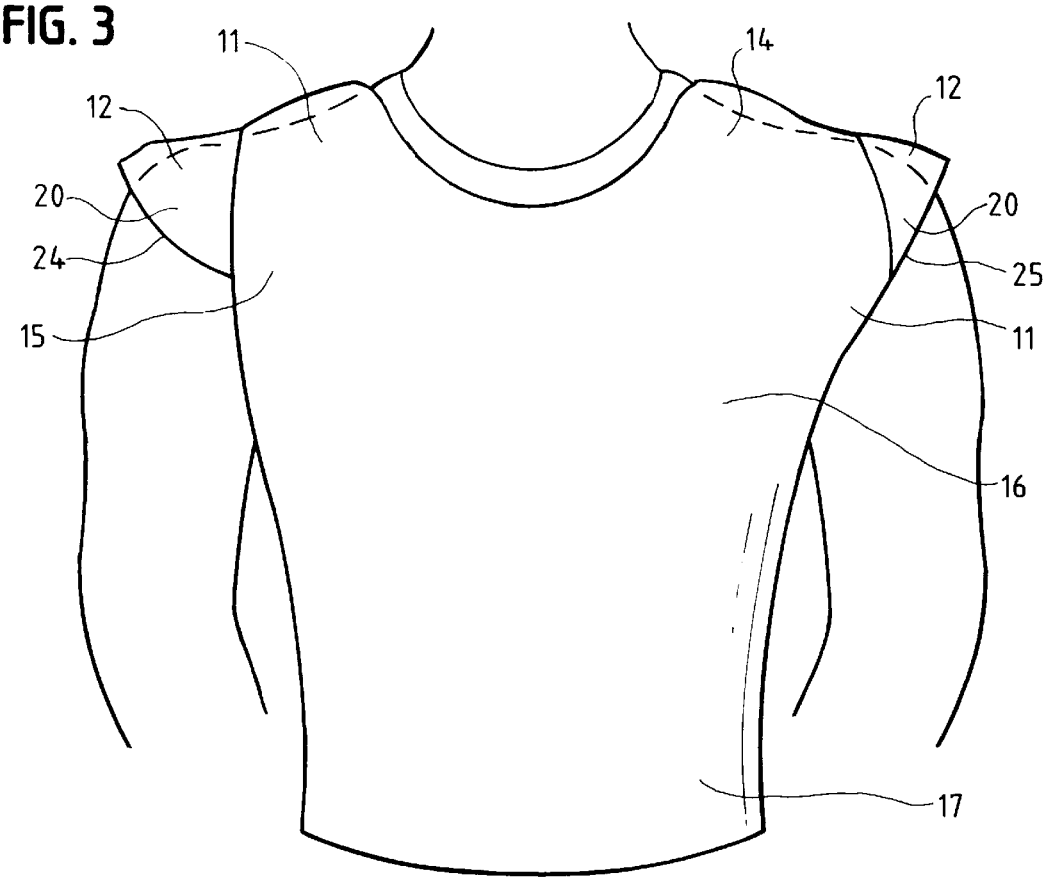
FIG. 3 is a front view of a catcher wearing an embodiment of the chest protector.
Figure 4:
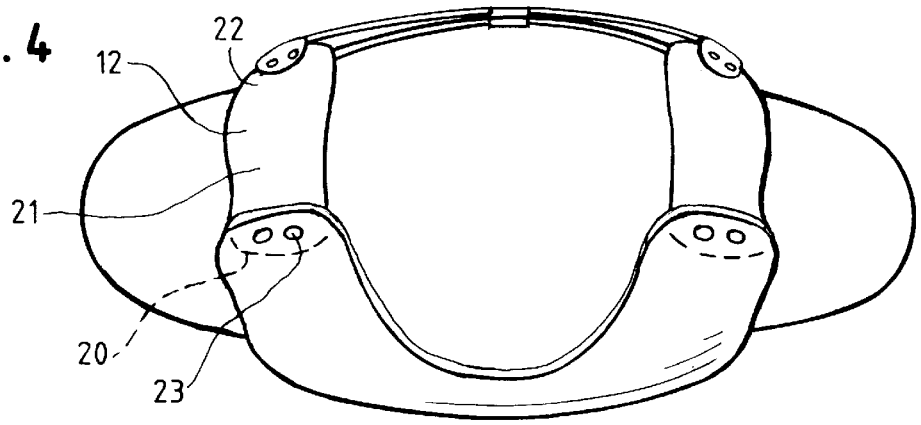
FIG. 4 is a top view of an embodiment of the chest protector.

As shown in FIG. 3, the shoulder guards 12 should extend outward to cover the shoulder of the wearer and extend slightly beyond the shoulder of the wearer. The guard should extend only slightly beyond the shoulder of the wearer to ensure that the wearer's throwing ability is not impaired. The shoulder guard 12 may include a side edge 24 that curves outwardly and upwardly from the shoulder portion of the chest protector, as shown with respect to the right shoulder guard in FIG. 3, or the side edge 25 may extend along the same line as the side edge of the shoulder portion, as shown with respect to the left shoulder guard in FIG. 3, depending upon the shape of the chest protector 10 to which the shoulder guards are applied.

The adjustable straps 13 may be made of leather or other suitable material, and are secured to the shoulder guards 12 and to the abdomen section 17 of the main pad 11 by a suitable fastening means 26, such as rivets or snaps.

The invention has been described above in an illustrative manner and it is to be understood that terminology which has been used is intended to be in the nature of description rather than of limitation. Obviously, many modifications and variations of the present invention are possible in light of the above teachings. It is therefore to be understood that within the scope of the appended claims, the invention may be practiced otherwise than as specifically described.

What is claimed is:

1. A baseball chest protector comprising:

a flexible main pad having a left shoulder portion, a right shoulder portion, a chest portion, and an abdomen portion;

a flexible shoulder guard extending from the left shoulder portion of the main pad over the shoulder of a wearer and having a front portion adjacent the main pad, a top portion, and a back portion; and adjustable straps, each adjustable strap attached at one end to the abdomen portion of the main pad and at the other end to the back portion of the shoulder guard.

* * * * *